United States Patent [19]

Covington

[11] 4,281,532

[45] Aug. 4, 1981

[54] PORTABLE APPARATUS FOR STRAIGHTENING AUTOMOBILE BODIES

[75] Inventor: Fred D. Covington, Albuquerque, N. Mex.

[73] Assignee: Portaframe, Inc., Albuquerque, N. Mex.

[21] Appl. No.: 131,623

[22] Filed: Mar. 19, 1980

[51] Int. Cl.[3] ..... B21J 13/08

[52] U.S. Cl. ..... 72/457; 72/705

[58] Field of Search ..... 72/709, 705, 457

[56] References Cited

U.S. PATENT DOCUMENTS

| | | | |
|---|---|---|---|
| 3,276,237 | 9/1962 | Transve | 72/705 X |
| 3,518,867 | 7/1970 | Rovis | 72/705 X |
| 3,673,842 | 7/1972 | Sanchez | 72/705 X |
| 3,754,427 | 8/1973 | Hunakuff et al. | 72/705 |
| 3,777,541 | 12/1973 | Whitney | 72/705 X |
| 4,023,394 | 5/1977 | Borup | 72/705 X |

*Primary Examiner*—Robert C. Watson

*Attorney, Agent, or Firm*—Walter R. Keller

[57] ABSTRACT

A portable apparatus for straightening automobile bodies comprising two longitudinal main beams, each telescoping in length, connected to each other by two telescoping transverse beams; two end bars slideably and telescoping attaching to the end of the main beams; a plurality of cross beams which removeably but rigidly attach to the main beams at a multitude of points; each main beam having thereon a plurality of tie downs; each cross beam being equiped with a plurality of load pads operated by hydraulic jacks; and the end bars also operated by hydraulic pads; the entire apparatus being assembled by pins for easy quick assembly and disassembly.

2 Claims, 7 Drawing Figures

PORTABLE APPARATUS FOR STRAIGHTENING AUTOMOBILE BODIES

BACKGROUND

1. Field of the Invention.

This invention relates to a portable hydraulic tool for reshaping damaged portions of automobile bodies and frames.

2. Description of Prior Art.

Present apparatus available for correcting misalignment of vehicles and for straightening frame and body parts of vehicles back to their pre-damaged locations, are large, bulky, heavy relatively permanently installed machines which occupy an entire bay of the repair shop. When not in use the present apparatus occupies space in the repair shop that could be otherwise used for other service and repairs on vehicles. This invention provides a practical apparatus which is easily and quickly disassembled when not in use, thereby freeing the garage repair bay for other use, and the attendant multiple use of the repair bay provides the repair shop with an economic advantage.

The apparatus known prior to this invention, did not provide a practical means for moving the apparatus and a damaged vehicle installed thereon. The present invention provides a significant degree of mobility, so that the apparatus with vehicle installed can be moved to virtually any location and thus eliminating conflicting operations in the repair shop.

The present invention allows for positioning of the vehicle on the apparatus and then performing a multitude of straightening operations, at time convenient to the mechanic, without removing. U.S. Pat. No. 3,276,237 discloses a portable apparatus for straightening automobile bodies; however, the portable apparatus of TRANSUE must be repositioned with respect to the vehicle for each operation on the vehicle while the present invention needs only to have an additional member added, and the present invention can apply a variety of and a multitude of forces to various parts of the automobile body simultaneously.

SUMMARY

The present invention is a portable apparatus for straightening the body and frame of damaged automobiles. The invention can be readily disassembled, transported to the location of a damaged vehicle, reassembled and attached to the damaged vehicle. The present invention then can be used to provide limited mobility to a damaged vehicle, or used at the site of the damaged vehicle to effect repairs. As used in a conventional auto repair garage, the invention can, with an automobile installed or without, be removed from a bay to make room for other auto repair operations in the bay, thus effecting a substantial economic savings for the management of the garage by more efficient use of space. Prior apparatus for straightening frames and bodies of damaged vehicles has been huge, bulky, and relatively immoveable.

It is therefore an object of this invention to provide a safe, relatively inexpensive, portable, mobile apparatus for straightening frames and bodies of damaged automobiles, and to bring such repairs within the economic capability of small garage owners, as well as to effect substantial savings in time and space utilization for even the larger garage owners.

DESCRIPTION OF THE PREFERRED EMBODIMENT

Figure 1:
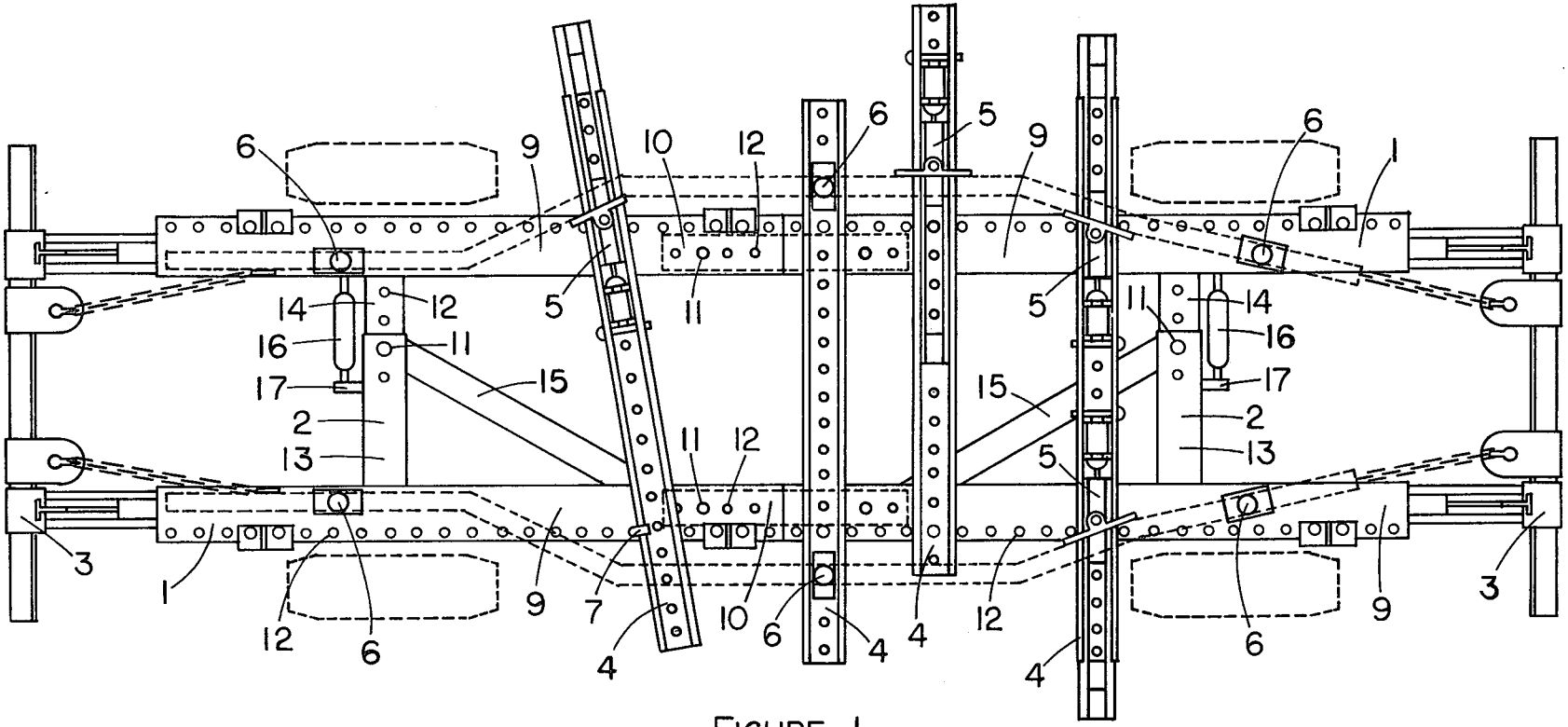
FIG. 1 is a top plan view of the apparatus.
Figure 7:
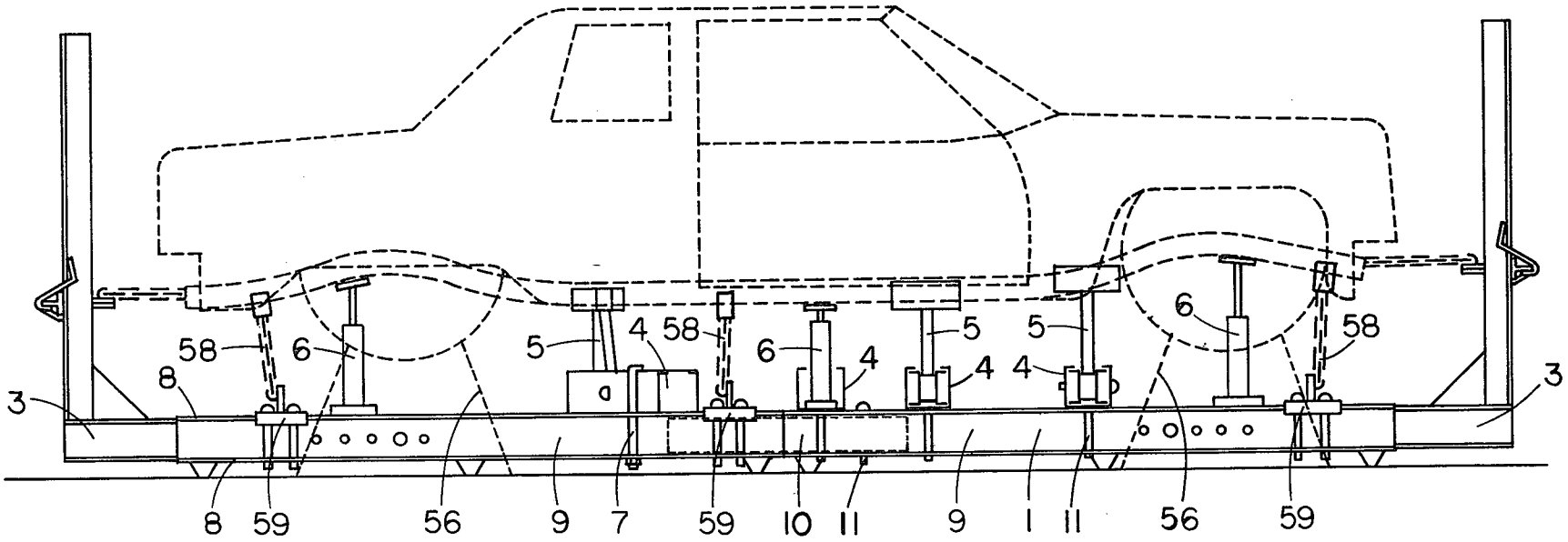
FIG. 7 is a side view of the invention with vehicle mounted thereon.

The invention as shown in FIG. 1 and FIG. 7 has two longitudinal main beams 1, telescopically connected to each other with two transverse beams 2. The invention also has two end bars 3 and a plurality of cross beams 4, a plurality of load pad units 5, support jacks 6, and a plurality of tie downs 7.

The main beams 1 are square box beams having two flanges 8 parallel to each other extending out from the corners of one side of the box and running the length of the main beams 1. Each main beam 1 consists of two half beams 9 which slideably mate to a connecting box beam 10 which slides inside the box of each half beam 9 thus permitting the main beams 1 to be telescopically adjusted in length. The length of the main beams 1 is held fast, once assembled, by pins 11 through pin holes 12 in the half beams 9 and the connecting box beams 10. The flanges 8 on each main beam 1 have a plurality of pin holes 12 evenly spaced along the length of each flange 8, and the pin holes 12 on each flange 8 are aligned so that a pin 11 through one flange may also pass through a pin hole 12 on the other flange 8 on the main beam 1.

Rigidly affixed to each main beam 1 are the large transverse half beams 13 and a small transverse half beam 14. The large transverse half beams 13 are rigidly affixed at right angles to each half beam 9 on the side opposite the flanges 8 on one of the main beams 1. To enhance the rigidity of the invention, angle braces 15, or the equivalent such as corner plates, are rigidly affixed such as by welding between the larger transverse half beam 13 and the half beam 9. The smaller transverse half beams 14 are rigidly affixed at right angles to each half beam 9 on the side opposite the flanges 8 on the other main beam 1. The larger transverse half beam 13 and the smaller transverse half beam 14 are box beams sized so that the smaller transverse half beam 14 slideably inserts into the larger transverse half beam 13. Both the larger transverse half beam 13 and the smaller transverse half beams 14 have a plurality of pin holes 12 vertically aligned so that when the main beams 1 are properly spaced apart, and the small transverse half beams 14 is telescopically inserted into the large transverse half beams 13, pins 11 are passed through pin holes 12 in the transverse beams 2 securing the transverse beam 2 in a fixed width. Depending on the size and weight of the main beams 1, adjustment of the main beams 1 in the aforesaid assembly may be manual, or can be mechanically or power aided by a mechanical or hydraulic jack 16 merely by providing an attaching means to one of the main beam 1 and a load bearing point on the other main beam 1. As shown in FIG. 1 a standard two way hydraulic jack 16, is attached at its base to one main beam 1 along side the smaller transverse half beam 14, and attached to a load tang 17 on the larger transverse half beam 13. The load tang 17 is a flat plate rigidly attached at right angles to a side of the larger transverse half beam 14, having a hole through which a bolt is attached to a jack 16. By operating the jack the two main beams 1 can be adjusted with respect to each other.

Figure 2:
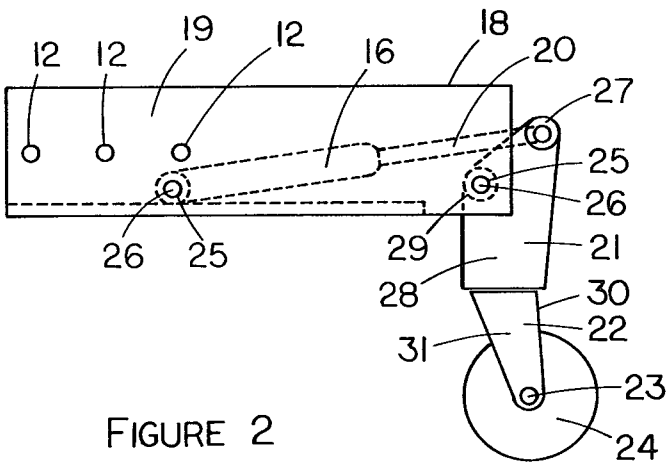
FIG. 2 is a side view of a removeable wheel unit.
Figure 3:
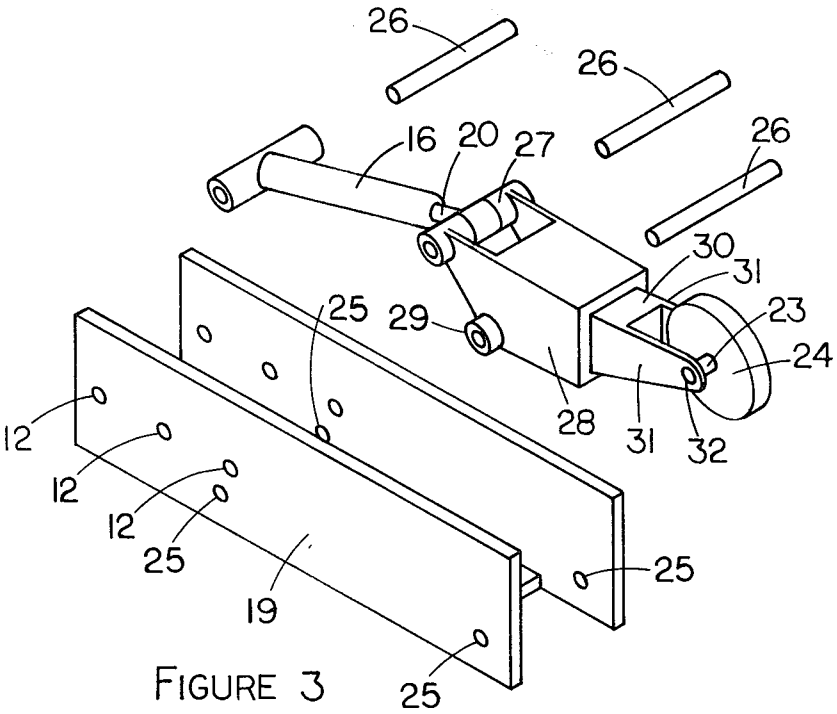
FIG. 3 is an exploded isometric view of the removeable wheel unit.

FIGS. 2 and 3 show a removeable wheel unit 18. The removeable wheel unit 18 consists of a support beam 19, a hydraulic jack 16 having a jack piston rod 20, a lever arm 21, a castor yoke 22, a castor axle 23, and castor 24. The support beam 19 is a box beam sized to slideably insert into an end of the main beam 1; and the support beam has a plurality of pin holes 12 which align with pin holes 12 through the sides of the main beam 1. In addition, pivot holes 25 are provided in the sides of the support beam 19 near the bottom of the support beam 19, and through the lever arm 21. The support beam 19 is slideably inserted into one end of one main beam 1 and pinned by a plurality of pins 11 inserted through pin holes 12, in such a manner that the end of the support beam having pivot holes 25 extends beyond the main beam 1. A hydraulic jack 16 with a rotary attaching end is pivoted inside the support beam 19 by means of a pivot pin 26 which passes through pivot holes 25. The piston rod 20 of the hydraulic jack 16 is pivotally attached to the support beam 19. The lever arm 21 has a pivot end 27 and a castor end 28. The lever arm 21 is a generally trapezoidal box beam sized to allow the pivot end 27 to be retracted inside the support beam 19. Offset and lower than the pivot end 27 on the lever arm 21 is the knee pivot 29, a hole through the lever arm 21, through which a pivot pin 26 is pivotally connecting the lever arm 21 to the support beam 19 at the pivot holes 25 near the end of the support beam 19. The castor end 28 of the lever arm 21 has rotatably attached thereto the castor yoke 22. The castor yoke 22 is a U shaped member having a base 30 which is rotatably attached to the castor end 28, and two axle flanges 31 having an axle hole 32 in each. Through the axle holes 32 the castor axle 23 being rod like with the yoke 22 are of standard and known construction. One of the removable wheel units 18 is installed in each end of each main beam 1 thus enabling the invention to be raised to a wheeled position. When desired the invention may be lowered and the wheel unit 18 removed.

Figure 4:
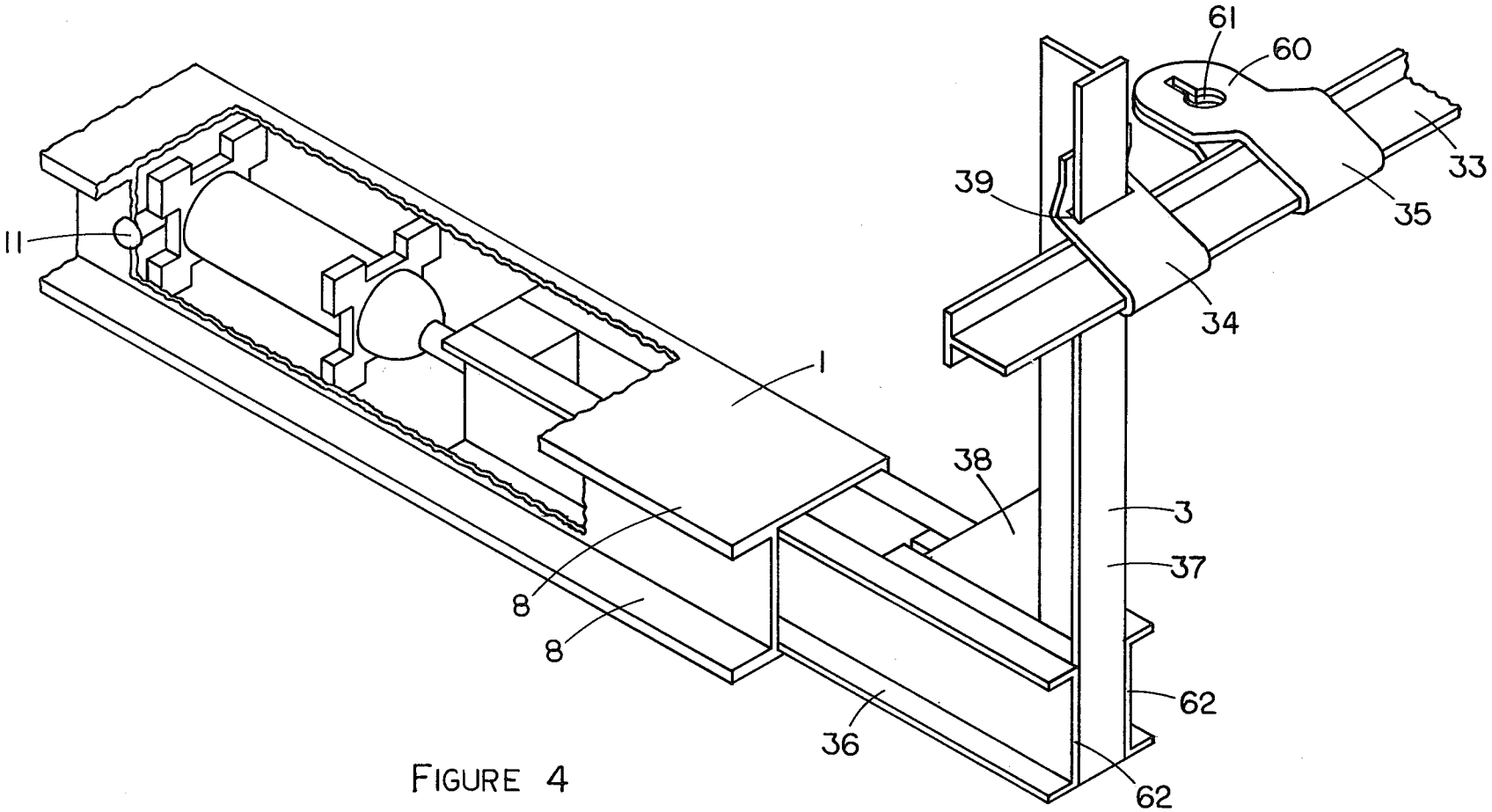
FIG. 4 is an isometric view of one half of an end bar.
Figure 5:
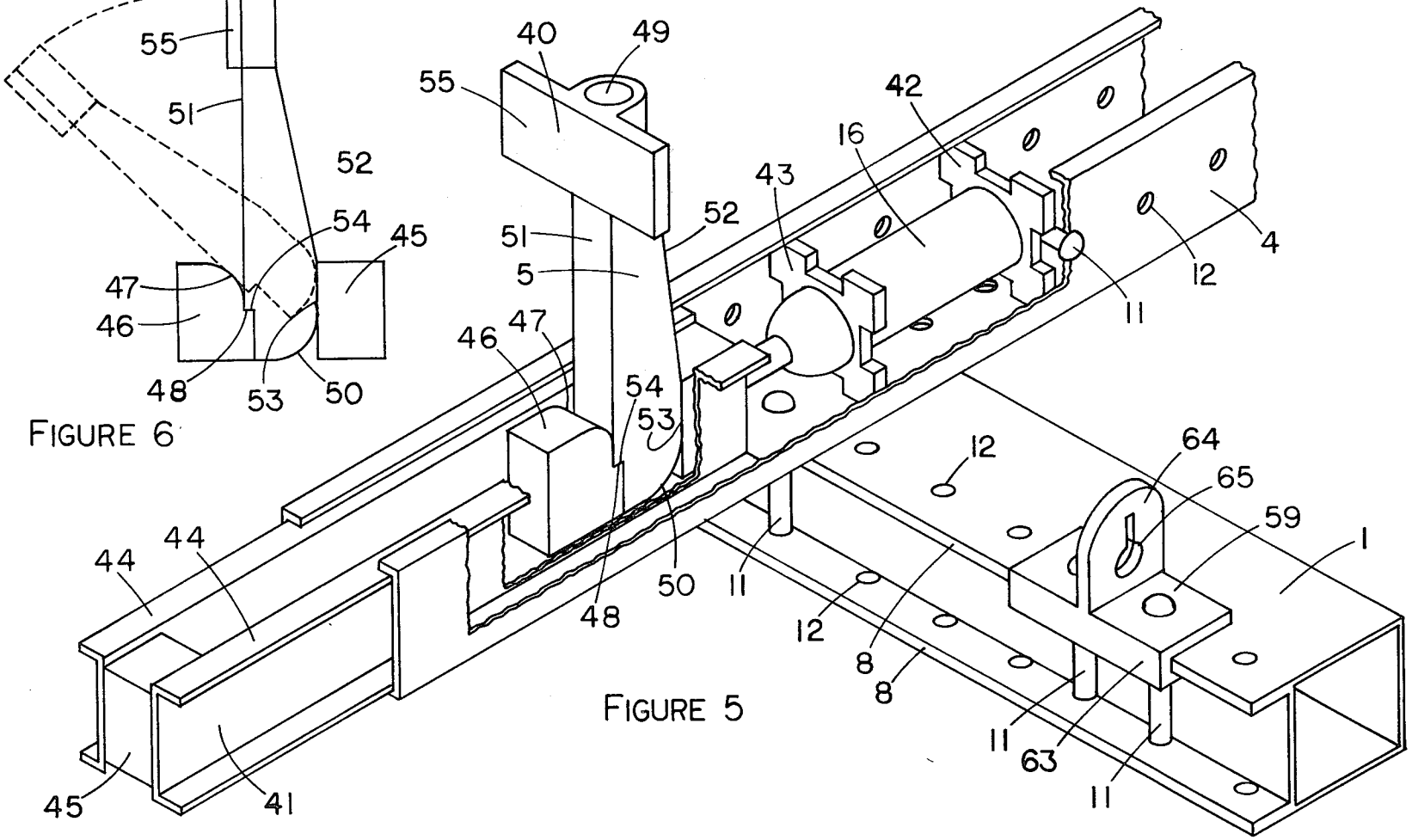
FIG. 5 is an isometric view with cut away showing a load pad unit.
Figure 6:
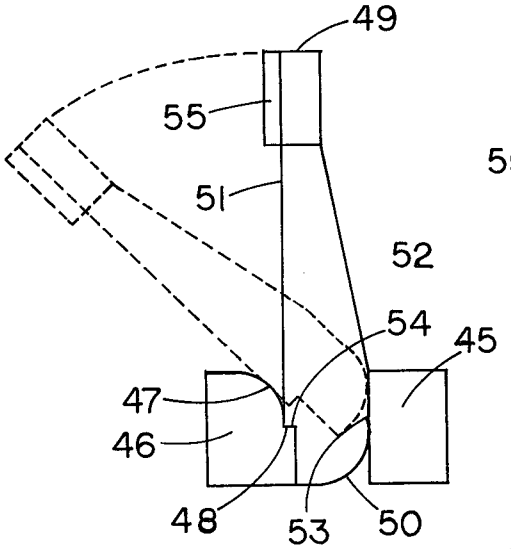
FIG. 6 is a side view of the load pad unit.

FIG. 1 and FIG. 4 show the end bars 3 slideably mate to the main beams 1 and may be pinned in position. Each end bar 3 consists of two channels 62 a tie bar 33, two slide clamps 34 and two slideable chain clasps 35. Each channel 62 has a horizontal beam 36 sized to slideable insert in the end of the main beam 1. Rigidly connected to right angles to the horizontal beam 36 is a vertical post 37, are further rigidly connected by a web 38 which enhances the rigidity of the channel 62. The slide clamps 34 are generally spring wedge shaped pieces which have slots 39 on which slide over the top of the T in a vertical post 37 yet have space to allow the tie bar 33 to slide through the slide clasp 34, and the tie bar 33 is slideably passed through the slide clasps 34 on vertical posts 37 mated to the adjacent ends of the main beams 1. Slideably installed on the tie bar 33, which is generally a T bar similar to the vertical posts 36, is a pair of chain clasps 35. The chain clasps 35 are metal bands of sufficient strength bent to be able to slide over the tie bar 33 and the ends of the chain clamp 35 fastened together as by welding to form a tongue 60 through which a chain hole 61 shaped like a key hole is made. Chain may then be passed through the chain hole 61 and secured in the chain hole 61. Thus assembled, the invention is next provided with a plurality of cross beams 4. These cross beams 4 are sufficient length to reach across both main beams 1 and extend on each side of the main beams 1. The cross beams 4 are channels having a plurality of pin holes 12 sized identical to the pin holes 12 in the main beams 1. When the cross beam 4 are to be engaged at an angle other than a right angle across the main beams 1 the cross beam 4 is pinned to the main beam 1 at one end and a tie down 7 secures the cross beam 4 to other main beam 1. The tie down 7 is an L bolt which hooks on top of the cross beam 4 and bolts through a pin hole 12 in the upper and lower flange of the main beam 1. The cross beams 4 also have a plurality of pin holes 12 along, and aligned with each other on each of the flanges of the channel. Slideably mated in the cross beams 4 are load pad units 5 as shown in FIG. 5. Each load pad unit 5 consists of a load pad 40, jack ram 41, and a hydraulic jack 16. The hydraulic jack 16, a standard and known unit, is fitted with a jack base 42, and a jack collar 43. The jack base 42 and jack collar 43 are flat plates of sufficient size to be removeably engaged on the hydraulic jack, and are generally rectangular to slideably insert into the cross beams 4 to provide the support required for the hydraulic jack 16, to be centered in a longitudinal manner inside the cross beam 4. A pin 11 is passed through the pin holes 12 in the flanges of the U channel of the cross beam 4 providing a base for hydraulic jack 16. The jack ram 41 is slideably inserted into the cross beam 4 so that it touches the jack piston of the hydraulic jack 16. The jack ram is a beam made of two channel irons 44 back to back welded or rigidly affixed to spacer blocks 45 at the ends of the channel irons 44. A pivot block 46 is rigidly and fixedly installed between the channel irons 44 near one end of the jack ram 41 so that the space between the spacer block 45 and the pivot block 46 will accommodate the load pad 40. The pivot block 46 generally rectangular in shape with one upper corner rounded 47 and one side having a step 48. The load pad 40 is a vertical member having a top 49, a bottom 50, and a working face 51, and a back 52. The bottom 50 is curved so that there is not a corner between the bottom 50 and the back 52. The back 52 has vertical flat 53 to engage the end spacer block 45. The working face 51 has a step 54 which matches the step 48 on the pivot block 46. At the top 49 of the load pad 40 at right angles to the working face 51, is a force pad 55 which is generally flat and rectangular. The top of the load pad 49 is cylindrical and the force pad 55 generally flat has a cylindrical mount on its back face which slideably mates with the top of the load pad 49. The load pad 40 can now be inserted into the jack ram 41 so that the steps 48 and 54 engage and the flat 53 engages the spacer block 45, and raised to the vertical. The force pad 55 bears against the damaged vehicle and the force of the hydraulic jack 16 is transmitted through the piston of the hydraulic jack 16 to the jack ram 41 to the load pad 40 to the vehicle.

To load a damaged vehicle on the invention the main beams 1 are assembled and the wheel units 18 installed and the main beams 1 then castored under the vehicle. The wheel unit 18 is then further actuated raising the main beams 1 and the vehicle. Standard stands 56 or blocks are placed under the vehicle. The main beams 1 are then lowered to the floor and jacks 6 are then installed between the main beams 1 and the vehicle at any of the plurality of points. The vehicle can then be tied down to the main beams 1 by chains 58 and clamps 59 at a variety of points. Means for attaching the chains 58 to the vehicle are standard and known. Clamps 59 as shown in FIG. 5, are one integrally made unit having a C shaped base and a vertical lug 64 having a key hole 65 through which a chain 58 can be secured. The C shaped base 63 has a plurality of pin holes 12 through which pins 11 can be passed securing the clamp 59 to the upper flange of main beam 1. The main beams 1 are then elevated to an again castoring or moving position making the entire unit and vehicle moveable. When positioned properly in a work area, the main beams 1 are lowered, stands 56 reinstalled, wheel units 18 removed, end bars 3 and cross beams 4 positioned with the load units 5 in place, and the straightening process can be initiated.

All pin holes 12 are of one size, and all pins 11 are of one size, thus eliminating specialized parts and problems with assembly. All sliding or moving surfaces should be greased to prevent binding. All load units 5 are identical and the hydraulic jack 16 is standard throughout the invention. Consequently, in a matter of minutes the invention can be assembled or disassembled, and when disassembled the unit is easily transported in a pick-up truck.

I claim:

1. A portable and moveable apparatus for straightening automobile bodies comprising:

two longitudinal main beams telescopically connected to each other with two transverse beams, two end bars, a plurality of cross beams; and a plurality of load pad units; and a plurality of support jacks; and a plurality of tie downs; and a plurality of pins, and four removeable wheel units; and a plurality of clamps;

wherein each main beam comprise of two half beams being box beams with two parallel flanges extending from adjacent corners of the main beam and said flanges running the length of the main beams, said flanges each having a plurality of pin holes along its length, said pin holes being aligned with the corresponding pin hole in the other flange so that one of the plurality of pins may pass through a hole in each flange when installed, and wherein said half beams are telescopically connected by a connecting box beam sized to slideably mate inside each half beam; and wherein each of the transverse beams comprises a large transverse half beam and a smaller transverse half beam;

wherein the two large transverse half beam are rigidly affixed, each to a half beam of one main beam, and the two smaller transverse half beams are rigidly affixed to the half beams of the other main beam so that the smaller transverse half beams telescopically and slideably mate with the larger transverse half beam, and are pinned with pins through pin holes in the mated larger and smaller transverse half beams; and wherein corner plates are rigidly affixed between the larger transverse half beams and the corresponding half beams of the main beam; and wherein there is provided a means for adjusting the distance between the main beams during assembly of the apparatus; and wherein each of the removeable wheel units comprises of a support beam, a hydraulic jack, a lever arm, a castor yoke, castor axle, and castor; each said support beam being a box beam sized to slideably insert into an end of a main beam and said support beam being rigidly pinned to the end of the main beam by pins inserted through pin holes provided in the main beam and the support beam; said support beam having pivot holes and pivot pins pass through the pivot holes through a rotary end of the hydraulic jack thereby pivotally attaching a hydraulic jack inside the support beam; the hydraulic jack has a piston rod which is pivotally attached to the lever arm by pivot pins passing through pivot holes provided in the lever arm; said lever arm also having a castor end to which the castor yoke is rotatably affixed; said castor yoke supporting the castor axle and castor attached thereto; and wherein the end bars, each comprise two channels a tie bar two slide clamps and two slideable chain clasps; each channel having a horizontal beam having a plurality of pin holes so that the horizontal beam may be rigidly pinned to the main beam, and said channel having a vertical post, T shaped in crossedsection, and a web rigidly affixed between the vertical post and the horizontal beam; and each of the slide clamps being generally spring, wedge shaped, having T shaped slots enabling the spring clamps to slide vertically, when compressed, on the vertical posts; and the tie bar slideably inserts into one slide clamp on each vertical post which is mated by its respective horizontal beam to adjacent ends of the two main beams; slideably installed on the tie bar are two chain clasps which are metal bands which have a tongue through which a key hole slot is provided in order to secure chains from a vehicle; and wherein the cross beams are channel beams of sufficient length to extend substantially beyond the main beams, when the cross beams are placed upon and perpendicular to the assembled main beams, and the cross beams have a plurality of pin holes along the bottom of the channel and a long the vertical faces of the channel, the pin holes in the vertical faces of the channel being aligned so that a pin may pass through both faces; and the tie downs being an L shaped bolt which inserts through the pin holes and has thereon a nut on one end securing the bolt to a main beam, and the L shaped end hooking on to the cross beam when the cross beam is attached to the main beams at other than right angles, when the pin holes in the cross beam do not align with the pin holes in the main beam; and each of the plurality of load pad units comprising a load pad, jack ram and hydraulic jack, wherein the hydraulic jack is equipped with a jack base and a jack collar which slideably insert into the cross beam; and wherein a pin through pin holes, in the vertical faces of the channel provides the base support for the hydraulic jack; and the jack ram is a beam having two channel irons back to back rigidly affixed to two spacer blocks between and at the ends of the channel irons and having a pivot block rigidly affixed between the channel irons near one end of the jack ram, the pivot block being generally rectangular in shape with the side adjacent to the end of the jack ram having a step and the upper corner adjacent to the end of the jack ram being rounded; and the load pad being a vertical member having a top, a bottom, a working face, force pad, and back wherein the bottom is curved eliminating the corner between the bottom and the back, and the back having a vertical flat to engage the spacer block of the jack ram, the working face having a step to engage the step on the pivot block of the jack ram, and the top being cylindrical in shape, and the force pad being a generally flat face member having a cylindrical hollow mounting on its back so that the force pad slideably and rotatably mates on to the top of the load pad; and the support jacks which are hydraulic jacks that may be installed in side cross beams, or set on top of the main beams thereby holding up the vehicle, and the clamps are members having a C shaped base which slides over the upper flange of the main beams and having a vertical lug on the top of the C shaped base, said vertical lug having a key hole slot through which a chain may be secured and the clamps each having a plurality of pin holes, aligned so that a pin may pass through both faces of the C shaped base and through pin holes in the flanges of the main beams.

2. The apparatus of claim 1 wherein the means for adjusting the distance between the main beams comprise;

mounting a two way hydraulic jack on the side of one main beam, and mounting a load tang to the transverse half of the other main beam, said hydraulic jack piston ram then is attached to the load tang.

* * * * *